US008298369B2

(12) United States Patent
Maeda et al.

(10) Patent No.: US 8,298,369 B2
(45) Date of Patent: Oct. 30, 2012

(54) LIQUID SUPPLY METHOD, LIQUID SUPPLY APPARATUS, SUBSTRATE POLISHING APPARATUS, AND METHOD OF MEASURING SUPPLY FLOW RATE OF LIQUID

(75) Inventors: Koji Maeda, Tokyo (JP); Ryuichi Kosuge, Tokyo (JP); Hiroshi Shimomoto, Tokyo (JP); Soichi Isobe, Tokyo (JP); Toru Niwa, Aichi (JP)

(73) Assignees: Ebara Corporation, Tokyo (JP); CKD Corporation, Aichi (JP)

( * ) Notice: Subject to any disclaimer, the term of this patent is extended or adjusted under 35 U.S.C. 154(b) by 1118 days.

(21) Appl. No.: 11/714,106

(22) Filed: Mar. 6, 2007

(65) Prior Publication Data

US 2007/0221615 A1 Sep. 27, 2007

(30) Foreign Application Priority Data

Mar. 7, 2006 (JP) ..... 2006-61728

(51) Int. Cl.
*C03C 15/00* (2006.01)
*H01L 21/306* (2006.01)

(52) U.S. Cl. ..... 156/345.12; 156/345.15; 156/345.24

(58) Field of Classification Search ..... 156/345.12, 156/345.15, 345.24
See application file for complete search history.

(56) References Cited

U.S. PATENT DOCUMENTS

| | | | | |
|---|---|---|---|---|
| 6,125,876 | A | 10/2000 | Laederich et al. | |
| 6,328,629 | B1 * | 12/2001 | Togawa et al. | 451/8 |
| 6,457,852 | B1 | 10/2002 | Hiraoka et al. | |
| 7,037,560 | B1 * | 5/2006 | Shinriki et al. | 427/553 |
| 2001/0002361 | A1 * | 5/2001 | Kawashima et al. | 451/443 |
| 2003/0038115 | A1 * | 2/2003 | Sakaida et al. | 216/83 |
| 2006/0191871 | A1 * | 8/2006 | Chen et al. | 216/89 |
| 2007/0221615 | A1 * | 9/2007 | Maeda et al. | 216/57 |

FOREIGN PATENT DOCUMENTS

| | | |
|---|---|---|
| JP | 6-132268 | 5/1994 |
| JP | 2000-71173 | 3/2000 |

OTHER PUBLICATIONS

Machine Generated English Translation of JP 2000-071173 published Mar. 7, 2000.*

* cited by examiner

*Primary Examiner* — Sylvia T. MacArthur
(74) *Attorney, Agent, or Firm* — Wenderoth, Lind & Ponack, L.L.P.

(57) ABSTRACT

A liquid supply apparatus is to supply a polishing liquid from a polishing supply source onto a polishing surface of a polishing table at a predetermined flow rate. The liquid supply apparatus according to the present invention includes at least one supply tube for retaining the liquid supplied from the liquid supply source, an electropneumatic regulator for supplying a pressurized gas from a gas source to the supply tube, and a pipe having no narrow portion for controlling a flow rate of the liquid. The supply tube is vertically disposed. The pressurized gas supply mechanism is operable to supply the pressurized gas to the supply tube so as to supply the liquid, filling the supply tube, to the polishing surface of the polishing table via the pipe and a polishing liquid supply pipe.

6 Claims, 5 Drawing Sheets

LIQUID SUPPLY METHOD, LIQUID SUPPLY APPARATUS, SUBSTRATE POLISHING APPARATUS, AND METHOD OF MEASURING SUPPLY FLOW RATE OF LIQUID

BACKGROUND OF THE INVENTION

1. Field of the Invention

The present invention relates to a liquid supply method and a liquid supply apparatus for supplying a liquid, e.g., a polishing liquid for use in a polishing section of CMP or a processing liquid for use in a semiconductor fabrication apparatus, to a predetermined liquid-supply area. The present invention also relates to a substrate polishing apparatus using such a liquid supply apparatus, and a method of measuring a supply flow rate of a liquid.

2. Description of the Related Art

A conventional liquid supply apparatus of this type is disclosed in Japanese laid-open patent publication 11-126764, and FIG. 1 shows a structure of this type of apparatus. Hereinafter, a polishing liquid supply apparatus shown in FIG. 1 for supplying a mixture of slurry and pure water will be described. A polishing liquid supply apparatus 200 includes an injector (pump) 201, a self-control valve (constant-pressure valve) 202, a flow sensor 203, an orifice 204, and a controller 205. Pressurized air (at 0.3 MPa) is supplied alternately to supply ports of the injector 201 so as to increase pressure of slurry 207 or pure water 208 to a controllable level. The flow sensor 203 detects a flow rate of a liquid and sends a signal S thereof to the controller 205. This controller 205 adjusts pressure of air 209, which is to be supplied to the self-control valve 202, so that the flow rate of the liquid reaches a value that is preset in the controller 205. With this structure, a polishing liquid 210 is supplied to a polishing surface of a polishing table at the flow rate that is preset in the controller 205. The self-control valve 202 uses the orifice 204 for controlling the flow rate, and the flow sensor 203 has a differential pressure type orifice 203*a* therein.

The above-described polishing liquid supply apparatus 200 has several problems as follows:

(1) Since the orifice 204 is located downwardly (downstream) of the flow sensor 203, this orifice 204 could become clogged with the slurry 207. Even if the orifice 204 is not clogged, the slurry 207 is attached to the orifice 204, thus narrowing a path. If the path is narrower than is required, the flow rate cannot be controlled.

(2) Since the flow sensor 203 is a differential pressure type sensor having the orifice 203*a* therein, the same problems as described in (1) would arise.

(3) When flow of the liquid is suddenly changed by the orifices 203*a* and 204, the liquid is stressed. Depending on the type of liquid, such stress would change a property of the liquid, such as coagulation, exerting an influence on processing.

SUMMARY OF THE INVENTION

The present invention has been made in view of the above drawbacks. It is therefore an object of the present invention to provide a liquid supply method, a liquid supply apparatus, a substrate polishing apparatus, and a method of measuring a supply flow rate of a liquid which do not cause clogging of a pipe with particles, e.g., slurry, contained in a liquid and do not cause a change in property of the liquid with no stress on the liquid to be supplied.

One aspect of the present invention for achieving the above object is to provide a method of supplying a liquid from a liquid supply source to a predetermined liquid-supply area at a predetermined flow rate. The method includes supplying the liquid from the liquid supply source to at least one supply tube so as to fill the supply tube with the liquid, and then supplying a gas to the supply tube so as to discharge the liquid from the supply tube by pressure of the gas to the liquid-supply area via a pipe having no narrow portion for controlling a flow rate of the liquid. The supply tube is vertically disposed.

The present invention described above has a simple structure, does not cause clogging of the pipe with particles, e.g., slurry, contained in the liquid, and does not stress the liquid at all. Therefore, this method can supply the liquid to the liquid-supply area without causing a change in property of the liquid.

In a preferred aspect of the present invention, the method further includes adjusting the pressure of the gas to be supplied to the supply tube so as to control an amount of the liquid discharged from the supply tube to thereby control the flow rate of the liquid supplied to the liquid-supply area.

According to the present invention, because the pipe does not have any narrow portion, such as a flow rate control valve or an orifice, the pipe does not stress the liquid during supplying of the liquid.

In a preferred aspect of the present invention, the at least one supply tube comprises plural supply tubes. Supplying and discharging of the liquid are repeated between the plural supply tubes in coordination with each other so as to continuously supply the liquid to the liquid-supply area at the predetermined flow rate.

According to the present invention, the liquid can be continuously supplied to the liquid-supply area at the predetermined flow rate.

Another aspect of the present invention is to provide an apparatus for supplying a liquid from a liquid supply source to a predetermined liquid-supply area at a predetermined flow rate. The apparatus includes at least one supply tube for retaining the liquid supplied from the liquid supply source, a pressurized gas supply mechanism for supplying a pressurized gas from a gas source to the supply tube, and a pipe having no narrow portion for controlling a flow rate of the liquid. The supply tube is vertically disposed. The pressurized gas supply mechanism is operable to supply the pressurized gas to the supply tube so as to supply the liquid, filling the supply tube, to the liquid-supply area via the pipe.

The present invention described above does not cause clogging of the pipe with particles, e.g., slurry, contained in the liquid, and does not stress the liquid at all. Therefore, this apparatus can supply the liquid to the liquid-supply area without causing a change in property of the liquid.

In a preferred aspect of the present invention, the apparatus further includes a gas pressure adjusting mechanism for adjusting pressure of the gas to be supplied from the gas source to the supply tube. The gas pressure adjusting mechanism is operable to control the flow rate of the liquid by adjusting the pressure of the gas in the supply tube.

With this structure, because the pipe does not have any narrow portion, such as a flow rate control valve or an orifice, the pipe does not stress the liquid during supplying of the liquid.

In a preferred aspect of the present invention, the at least one supply tube comprises plural supply tubes, and supplying and discharging of the liquid are repeated between the plural supply tubes in coordination with each other so as to continuously supply the liquid to the liquid-supply area at the predetermined flow rate.

With this structure, the liquid can be continuously supplied to the liquid-supply area at the predetermined flow rate.

In a preferred aspect of the present invention, the apparatus further includes a cleaning mechanism for supplying a cleaning liquid into the plural supply tubes so as to clean the plural supply tubes. The cleaning mechanism is operable to successively clean interiors of the plural supply tubes upon termination of discharging of the liquid while the liquid is continuously supplied to the liquid-supply area.

With this structure, particles, e.g., slurry, contained in the liquid are not attached to or deposited on the interiors of the supply tubes. Therefore, the pipe downstream of the supply tubes can be maintained in a suitable condition for supplying the liquid.

In a preferred aspect of the present invention, the apparatus further includes a gas pressure adjusting mechanism for adjusting pressure of the gas to be supplied from the gas source to the supply tube, and a flow rate detection device for detecting the flow rate of the liquid to be supplied to the liquid-supply area by continuously measuring a liquid level in the supply tube. The gas pressure adjusting mechanism is operable to control the flow rate of the liquid based on an output signal of the flow rate detection device.

With this structure, the supply flow rate of the liquid can be precisely controlled with a simple controlling structure.

Another aspect of the present invention is to provide a substrate polishing apparatus includes a polishing table having a polishing surface, a polishing liquid supply unit for supplying a polishing liquid onto the polishing surface, and a substrate holding mechanism for holding a substrate and pressing the substrate against the polishing surface. The polishing table and the substrate holding mechanism are operable to provide relative movement between the polishing surface and the substrate to thereby polish the substrate. The polishing liquid supply unit comprises the above-described liquid supply apparatus.

With this structure, suitable polishing of the substrate can be performed without changing a property of the polishing liquid supplied onto the polishing surface of the polishing table.

Another aspect of the present invention is to provide a method of measuring a flow rate of a liquid to be supplied by a liquid supply apparatus to a predetermined liquid-supply area. The liquid supply apparatus is operable to supply the liquid from a liquid supply source to a vertically disposed supply tube so as to fill the supply tube with the liquid and to supply a gas to the supply tube so as to discharge the liquid from the supply tube by pressure of the gas to the liquid-supply area. This method includes continuously measuring a liquid level in the supply tube so as to measure the flow rate of the liquid.

With this structure, the flow rate of the liquid can be measured without using a complicated flow sensor.

DETAILED DESCRIPTION OF THE PREFERRED EMBODIMENTS

Figure 1:
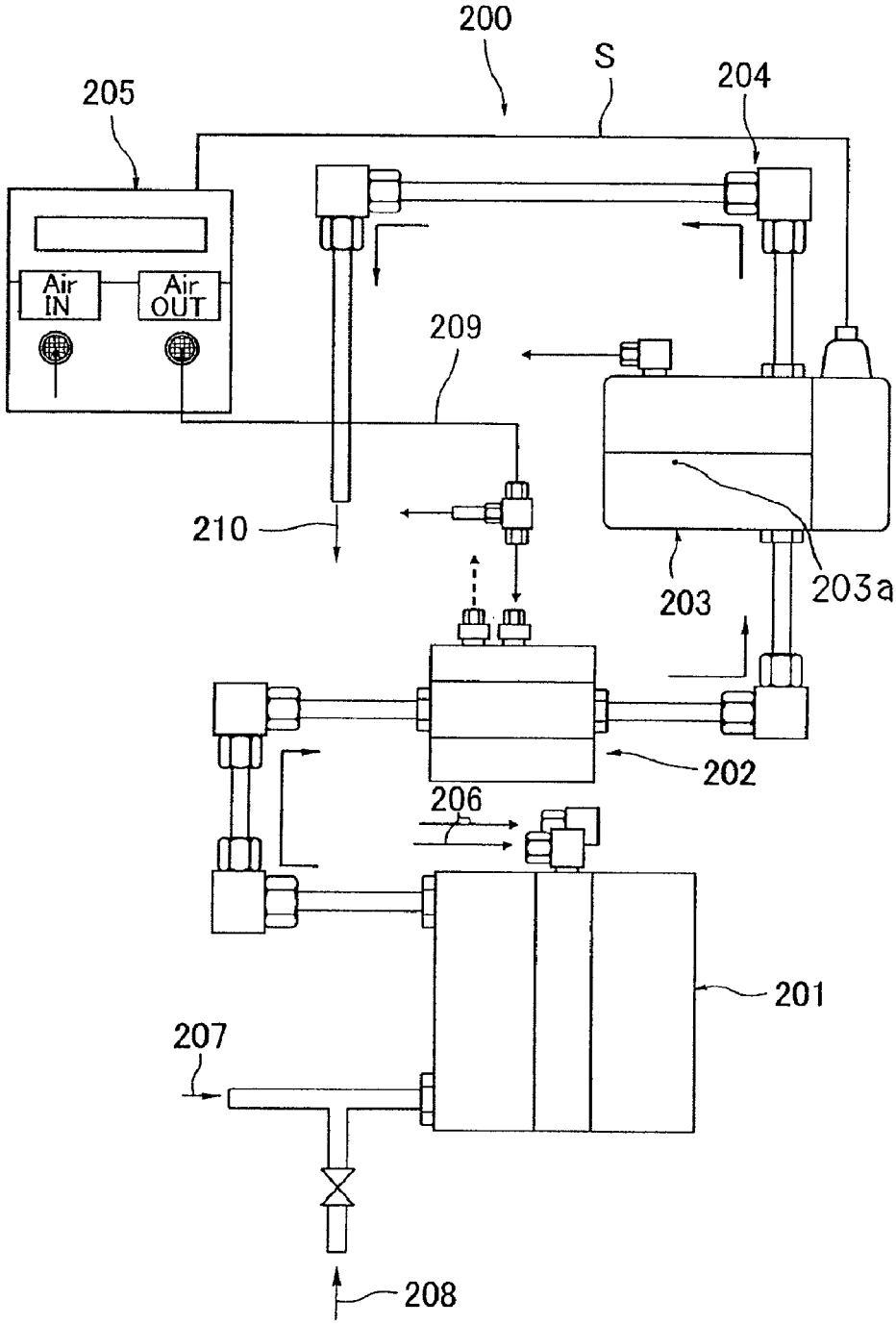
FIG. 1 PRIOR ART
FIG. 1 is a view showing a structural example of a conventional liquid supply apparatus.
Figure 2:
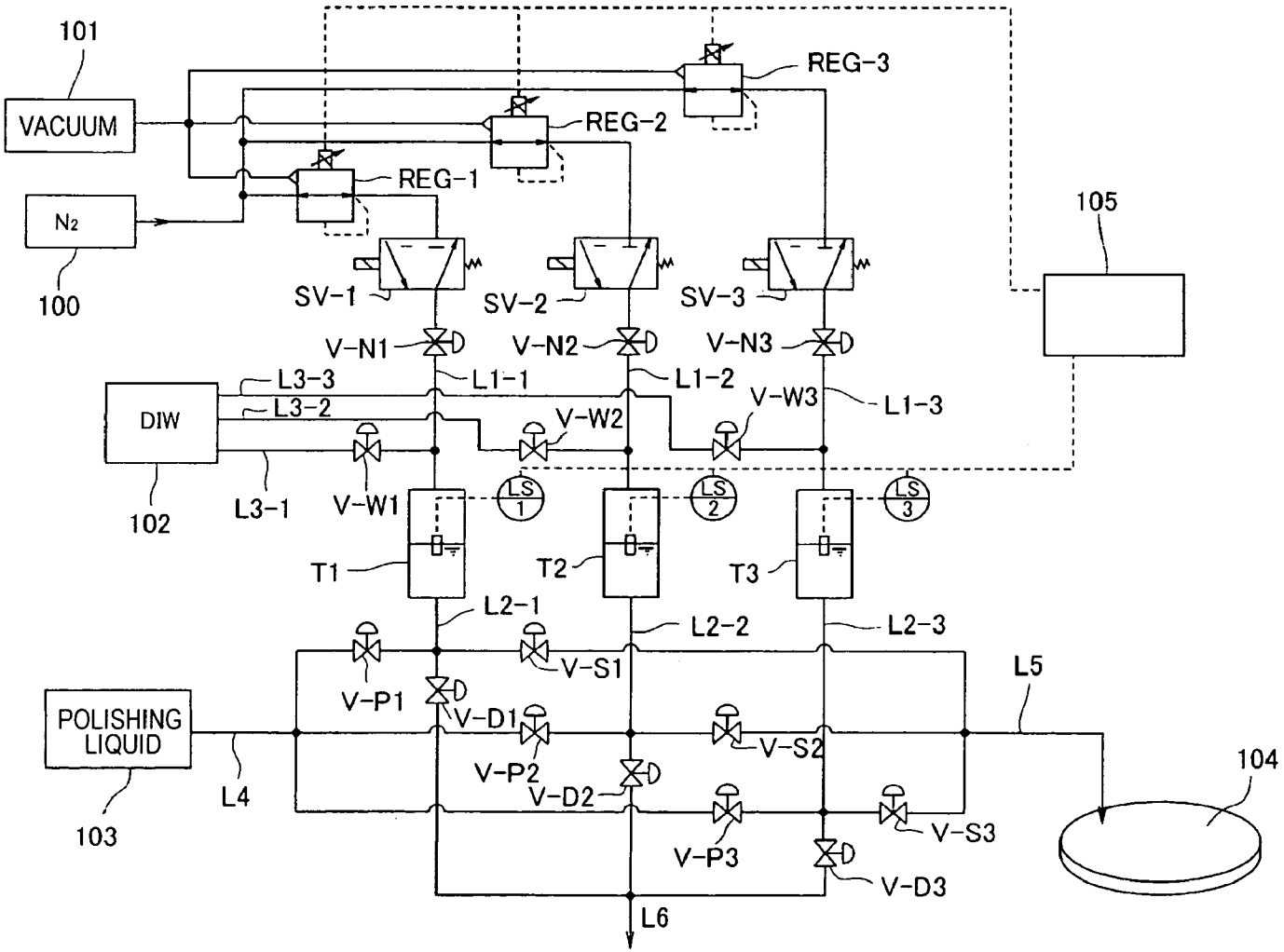
FIG. 2 is a view schematically showing a structural example of a liquid supply apparatus according to the present invention.

Embodiments of the present invention will be described below with reference to the drawings. This embodiment shows an example of a liquid supply apparatus for supplying a polishing liquid (abrasive liquid) onto a polishing surface of a polishing table incorporated in a CMP apparatus. FIG. 2 shows a schematic flow diagram of a liquid supply apparatus according to the present invention. In FIG. 2, T1, T2 and T3 represent supply tubes (cylindrical pressure vessels), respectively, which are to retain a liquid therein. These (three in this embodiment) supply tubes are vertically disposed. The supply tubes T1, T2 and T3 have respective upper openings and respective lower openings. The upper openings are connected to end portions of pipes L1-1, L1-2 and L1-3, respectively. The lower openings are connected to end portions of pipes L2-1, L2-2 and L2-3, respectively. The supply tubes T1, T2 and T3 have respective level sensors LS-1, LS-2 and LS-3 each for detecting a liquid level.

A DIW backflow prevention valve V-N1, a solenoid valve SV-1, and an electropneumatic regulator REG-1 are connected in series to the pipe L1-1. Similarly, a DIW backflow prevention valve V-N2, a solenoid valve SV-2, and an electropneumatic regulator REG-2 are connected in series to the pipe L1-2. Further, a DIW backflow prevention valve V-N3, a solenoid valve SV-3, and an electropneumatic regulator REG-3 are connected in series to the pipe L1-3. The other end portions of the pipes L1-1, L1-2 and L1-3 are connected to each other to form a single pipe that is connected to a nitrogen ($N_2$) gas source 100. The electropneumatic regulators REG-1, REG-2 and REG-3 are connected to a vacuum source 101. The end portions of the pipes L1-1, L1-2 and L1-3, which are connected to the upper openings of the supply tubes T1, T2 and T3, are further connected respectively to end portions of pipes L3-1, L3-2 and L3-3 via DIW supply valves V-W1, V-W2 and V-W3. The other end portions of the pipes L3-1, L3-2 and L3-3 are connected to a DIW (pure water) supply source 102.

The end portions of the pipes L2-1, L2-2 and L2-3, which are connected to the lower openings of the supply tubes T1, T2 and T3, are further connected to a polishing liquid filling pipe L4 via polishing liquid filling valves V-P1, V-P2 and V-P3, respectively. This polishing liquid filling pipe L4 is connected to a polishing liquid supply source 103. Further, these end portions of the pipes L2-1, L2-2 and L2-3 are connected to a polishing liquid supply pipe L5 via polishing liquid supply valves V-S1, V-52 and V-53, respectively. A polishing liquid is supplied through the polishing liquid supply pipe L5 onto the polishing surface of the polishing table 104. Further, the respective end portions of the pipes L2-1, L2-2 and L2-3 are connected to a discharge pipe L6 via discharge valves V-D1, V-D2 and V-D3, respectively. The pipes L2-1, L2-2 and L2-3, the polishing liquid filling pipe L4, and the polishing liquid supply pipe L5 do not have any narrow portion, such as an orifice, for controlling a flow rate.

The solenoid valves SV-1, SV-2 and SV-3 are for venting the supply tubes T1, T2 and T3 to atmosphere and for allowing the supply tubes T1, T2 and T3 to communicate with the electropneumatic regulators REG-1, REG2 and REG-3.

When the solenoid valves SV-1, SV-2 and SV-3 are operated to the atmospheric side and when the DIW backflow prevention valves V-N1, V-N2 and V-N3 and the polishing liquid filling valves V-P1, V-P2 and V-P3 are opened with no polishing liquid retained in the supply tubes T1, T2 and T3, the polishing liquid is supplied from the polishing liquid supply source 103 to fill the supply tubes T1, T2 and T3. The levels of the polishing liquid in the supply tubes T1, T2 and T3 are continuously detected by the level sensors LS-1, LS-2 and LS-3, which send detection signals thereof to a control unit 105. When the liquid levels reach predetermined "high levels", the control unit 105 closes the polishing liquid filling valves V-P1, V-P2 and V-P3 to thereby stop supply of the polishing liquid.

When a nitrogen gas is supplied from the nitrogen ($N_2$) gas source 100 to the respective supply tubes T1, T2 and T3 via the electropneumatic regulators REG-1, REG2 and REG-3 with the supply tubes T1, T2 and T3 filled with the polishing liquid, the polishing liquid in the respective supply tubes T1, T2 and T3 is discharged through the lower openings thereof into the pipes L2-1, L2-2 and L2-3 and is further delivered through the polishing liquid supply valves V-S1, V-52 and V-53 and the polishing liquid supply pipe L5 to the polishing surface (upper surface) of the polishing table 104. In order to control the flow rates of the polishing liquid being discharged from the respective supply tubes T1, T2 and T3, the electropneumatic regulators REG-1, REG2 and REG-3 control pressure of the nitrogen gas to be supplied to the supply tubes T1, T2 and T3. Specifically, in order to allow the respective supply tubes T1, T2 and T3 to discharge the polishing liquid therefrom at a constant flow rate, the electropneumatic regulators REG-1, REG2 and REG-3 adjust the pressure of the nitrogen gas to be supplied to the supply tubes T1, T2 and T3. The electropneumatic regulators REG-1, REG2 and REG-3 are connected to the vacuum source 101 in order to enhance response of the electropneumatic regulators REG-1, REG2 and REG-3.

The presence of the polishing liquid in the respective supply tubes T1, T2 and T3 and the flow rates of the polishing liquid discharged therefrom can be determined by detecting the liquid levels with the level sensors LS-1, LS-2 and LS-3. Specifically, since cross-sectional areas of the supply tubes T1, T2 and T3 are known, the flow rates of the polishing liquid discharged therefrom can be determined by detecting the liquid levels. The level sensors LS-1, LS-2 and LS-3 may be of an eddy current type which outputs a signal indicating a position of a float, or may be of an ultrasonic type. Any type of sensor can be used so long as it can continuously detect a liquid level.

When the DIW backflow prevention valves V-N1, V-N2 and V-N3 are closed and the DIW supply valves V-W1, V-W2 and V-W3 and the DIW discharge valves V-D1, V-D2 and V-D3 are opened with no polishing liquid retained in the supply tubes T1, T2 and T3, a cleaning liquid, i.e., DIW (pure water), is supplied into and discharged from the supply tubes T1, T2 and T3 to thereby clean interiors of the respective supply tubes T1, T2 and T3. After cleaning, the DIW supply valves V-W1, V-W2 and V-W3 are closed and the DIW backflow prevention valves V-N1, V-N2 and V-N3 are opened to thereby supply the nitrogen gas into the supply tubes T1, T2 and T3, so that the cleaning liquid is expelled (purged) from the interiors of the respective supply tubes T1, T2 and T3.

Specific operations of the above-described liquid supply apparatus are performed in the following order:

(1) Under the conditions that the supply tube T1 does not retain the polishing liquid therein and has already been cleaned and that the polishing liquid supply valve V-S1 and the discharge valve V-D1 are closed, filling of the supply tube T1 with the polishing liquid is firstly performed. Specifically, the DIW backflow prevention valve V-N1 is opened, the solenoid valve SV-1 is operated so as to communicate with the atmosphere, and the polishing liquid filling valves V-P1 is opened, so that the polishing liquid is supplied from the polishing liquid supply source 103 into the supply tube T1, thus filling the supply tube T1. The liquid level in the supply tube T1 is detected by the level sensor LS-1. When this liquid level reaches the predetermined "high level", the control unit 105 closes the polishing liquid filling valve V-P1 to stop supply of the polishing liquid, whereby filling of the supply tube T1 with the polishing liquid is completed.

(2) Discharging of the polishing liquid is then performed. Specifically, the solenoid valve SV-1 is operated so as to communicate with the electropneumatic regulator REG-1, and the DIW backflow prevention valve V-N1 and the polishing liquid supply valve V-S1 are opened, so that the nitrogen gas is supplied from the nitrogen gas supply source 100 into the supply tube T1 via the electropneumatic regulator REG-1. This nitrogen gas is adjusted such that the polishing liquid is discharged at the predetermined flow rate. The level sensor LS-1 continuously detects the liquid level and sends the signal thereof to the control unit 105. This control unit 105 performs a feedback control so as to maintain the flow rate of the polishing liquid at the above-described preset value. More specifically, the control unit 105 compares a detection value indicating the flow rate of the polishing liquid discharged and the preset value, and sends a signal indicating a difference between these values to the electropneumatic regulator REG-1. Simultaneously, the supply tube T2 is filled with the polishing liquid. Specifically, the DIW backflow prevention valve V-N2 is opened, the solenoid valve SV-2 is operated so as to communicate with the atmosphere, and the polishing liquid filling valve V-P2 is opened, so that the polishing liquid is supplied from the polishing liquid supply source 103 into the supply tube T2. The liquid level in the supply tube T2 is detected by the level sensor LS-2. When this liquid level reaches the predetermined "high level", the control unit 105 closes the polishing liquid filling valve V-P2 to stop supply of the polishing liquid, whereby filling of the supply tube T2 with the polishing liquid is completed.

(3) When the liquid level in the supply tube T1 reaches a "low level", discharging of the polishing liquid is terminated. Specifically, when the level sensor LS-1 detects the "low level", the DIW backflow prevention valve V-N1 and the polishing liquid supply valve V-S1 are closed, so that discharging of the polishing liquid from the supply tube T1 is terminated. Simultaneously, discharging of the polishing liquid from the supply tube T2 is started. Specifically, the DIW backflow prevention valve V-N2 is opened, the solenoid valve SV-2 is operated so as to communicate with the electropneumatic regulator REG-2, and the polishing liquid supply valve V-52 is opened, so that the nitrogen gas is supplied from the nitrogen gas supply source 100 into the supply tube T2 via the electropneumatic regulator REG-2. This nitrogen gas is adjusted such that the polishing liquid is discharged at the predetermined flow rate. Simultaneously, the supply tube T3 is filled with the polishing liquid. Specifically, the DIW backflow prevention valve V-N3 is opened, the solenoid valve SV-3 is operated so as to communicate with the atmosphere, and the polishing liquid filling valve V-P3 is opened, so that the polishing liquid is supplied from the polishing liquid supply source 103 into the supply tube T3, thus filling the supply tube T3.

(4) The interior of the supply tube T1 is then cleaned. Specifically, the DIW backflow prevention valve V-N1 is closed, and the DIW supply valve V-W1 and the discharge valve V-D1 are opened, so that DIW, serving as the cleaning liquid, is supplied into and discharged from the supply tube T1 for a predetermined period of time to thereby clean the interior of the supply tube T1.

(5) After the above-described period of time has elapsed and cleaning has been completed, purging of DIW from the supply tube T1 is performed. Specifically, the DIW supply valve V-W1 is closed and the DIW backflow prevention valve V-N1 is opened for a predetermined period of time, so that the nitrogen gas is supplied into the supply tube T1 via the electropneumatic regulator REG-1 at a flow rate that is necessary for expelling (purging) the cleaning liquid. In this manner, DIW in the supply tube T1 is expelled (purged). After the predetermined period of time has elapsed and expelling of DIW is completed, the DIW backflow prevention valve V-N1 and the discharge valve V-D1 are closed.

(6) When the liquid level in the supply tube T2 reaches a "low level", discharging of the polishing liquid is terminated. Specifically, when the level sensor LS-2 detects the "low level", the DIW backflow prevention valve V-N2 and the polishing liquid supply valve V-52 are closed. Simultaneously, discharging of the polishing liquid from the supply tube T3 is started. Specifically, the DIW backflow prevention valve V-N3 is opened, the solenoid valve SV-3 is operated so as to communicate with the electropneumatic regulator REG-3, and the polishing liquid supply valve V-53 is opened, so that the nitrogen gas is supplied from the nitrogen gas supply source 100 into the supply tube T3 via the electropneumatic regulator REG-3. This nitrogen gas is adjusted such that the polishing liquid is discharged at the predetermined flow rate. Simultaneously, the supply tube T1 is filled with the polishing liquid in the same manner as described above.

(7) Thereafter, filling of the supply tube with the polishing liquid, discharging of the polishing liquid therefrom, cleaning, and purging of the cleaning liquid are repeated in the order of the supply tubes T1, T2 and T3.

As described above, because the pipes L2-1, L2-2 and L2-3, the polishing liquid filling pipe L4, and the polishing liquid supply pipe L5 do not have any narrow portion, such as an orifice, for controlling the flow rate, these pipes are not clogged with particles, e.g., slurry, contained in the polishing liquid and thus do not stress the polishing liquid when supplying the polishing liquid. Therefore, a property of the polishing liquid is not changed, and there is no adverse influence on polishing of a workpiece.

The operations of the above-described liquid supply apparatus can be summarized as in the following items (a) through (d).

(a) The supply tube T is filled with a liquid, e.g., the polishing liquid, and then a gas, e.g., the nitrogen gas, is supplied into the supply tube T, so that pressure of the gas forces the liquid out of the supply tube T.

(b) The pressure of the gas is controlled by the electropneumatic regulator REG so that the liquid is discharged at a predetermined flow rate.

(c) The liquid level in the supply tube T is continuously measured by the level sensor LS, and the flow rate of the liquid is obtained from the measurement results. The control unit 105 performs a feedback control on the electropneumatic regulator REG so as to keep the flow rate of the liquid constant.

(d) The plural supply tubes T are used such that filling the supply tube with the liquid, discharging the liquid therefrom, and cleaning the supply tube T are successively repeated between the supply tubes T in coordination with each other. With these operations, the liquid can be continuously discharged at a constant flow rate, and the interiors of the supply tubes T can be cleaned during liquid supply.

Figure 3:
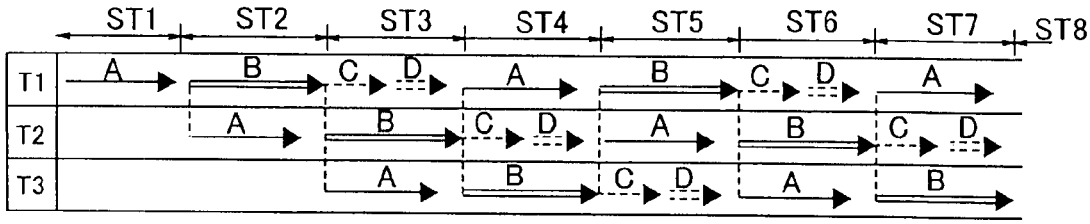
FIG. 3 is a view showing an operation chart in a case where three supply tubes are provided in the liquid supply apparatus according to the present invention.

FIG. 3 is a view showing an operation chart in a case where the liquid supply apparatus has three supply tubes T1, T2 and T3. In FIG. 3, arrow A indicates filling of the tube with a liquid, arrow B indicates discharging of the liquid, arrow C indicates cleaning, and arrow D indicates purging of a cleaning liquid. As shown in FIG. 3, during a period ST1, filling of the supply tube T1 with the liquid is performed. During a period ST2, discharging of the liquid from the supply tube T1 and filling of the supply tube T2 with the liquid are performed. During a period ST3, cleaning of the supply tube T1, purging of the cleaning liquid from the supply tube T1, discharging of the liquid from the supply tube T2, and filling of the supply tube T3 with the liquid are performed. During a period ST4, filling of the supply tube T1 with the liquid, cleaning of the supply tube T2, purging of the cleaning liquid from the supply tube T2, and discharging of the liquid from the supply tube T3 are performed. During a period ST5, discharging of the liquid from the supply tube T1, filling of the supply tube T2 with the liquid, cleaning of the supply tube T3, and purging of the cleaning liquid from the supply tube T3 are performed. During a period ST6, cleaning of the supply tube T1, purging of the cleaning liquid from the supply tube T1, discharging of the liquid from the supply tube T2, and filling of the supply tube T3 with the liquid are performed as with the period ST3. During a period ST7, filling of the supply tube T1 with the liquid, cleaning of the supply tube T2, purging of the cleaning liquid from the supply tube T2, and discharging of the liquid from the supply tube T3 are performed as with the period ST4.

Figure 4:
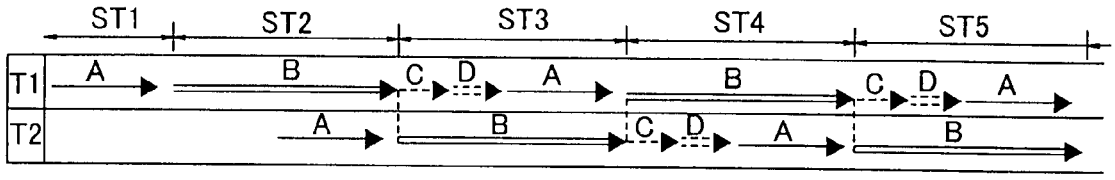
FIG. 4 is a view showing an operation chart in a case where two supply tubes are provided in the liquid supply apparatus according to the present invention.

FIG. 4 is a view showing an operation chart in a case where the liquid supply apparatus has two supply tubes T1 and T2. In FIG. 4, as with FIG. 3, arrow A indicates filling of the tube with a liquid, arrow B indicates discharging of the liquid, arrow C indicates cleaning, and arrow D indicates purging of a cleaning liquid. During a period ST1, filling of the supply tube T1 with the liquid is performed. During a period ST2, discharging of the liquid from the supply tube T1 and filling of the supply tube T2 with the liquid are performed. During a period ST3, cleaning of the supply tube T1, purging of the cleaning liquid from the supply tube T1, filling of the supply tube T1 with the liquid, and discharging of the liquid from the supply tube T2 are performed. During a period ST4, discharging of the liquid from the supply tube T1, cleaning of the supply tube T2, purging of the cleaning liquid from the supply tube T2, and filling of the supply tube T2 with the liquid are performed. During a period ST5, cleaning of the supply tube T1, purging of the cleaning liquid from the supply tube T1, filling of the supply tube T1 with the liquid, and discharging of the liquid from the supply tube T2 are performed as with the period ST3.

The flow rate of the liquid discharged from the supply tube T depends on the pressure of the nitrogen gas supplied to the supply tube T via the electropneumatic regulator REG. Therefore, in order to precisely keep the flow rate of the liquid constant, the electropneumatic regulator REG is required to be able to precisely adjust the pressure of the nitrogen gas. A commercially available electropneumatic regulator can be used as the electropneumatic regulator REG.

Figure 5:
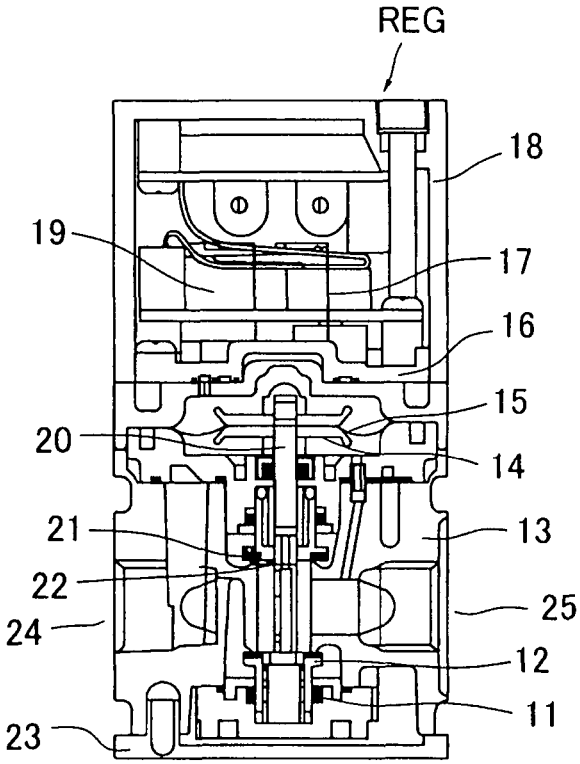
FIG. 5 is a view showing a structural example of an electropneumatic regulator.

FIG. 5 is a view showing a structural example of the electropneumatic regulator. In FIG. 5, a reference numeral 11 represents an O-ring, a reference numeral 12 represents a bottom valve, a reference numeral 13 represents a body, a reference numeral 14 represents a disk, a reference numeral 15 represents a diaphragm, a reference numeral 16 represents a valve base, a reference numeral 17 represents a pressure sensor, a reference numeral 18 represents a housing, a reference numeral 19 represents a three way valve, a reference numeral 20 represents a rod, a reference numeral 21 represents a top valve, a reference numeral 22 represents E-shaped snap ring, a reference numeral 23 represents a plate cover, a reference numeral 24 represents an input port, and a reference numeral 25 represents an output port. The input 24 is to be connected to the nitrogen gas source 100 shown in FIG. 2, and the output port 25 is to be connected to the pipe L1.

In the electropneumatic regulator having the above-described structure, the input 24 is connected to the nitrogen gas source 100 shown in FIG. 2, and the output port 25 is connected to the pipe L1. Upon receiving the input signal from the control unit 105, the three way valve 19 is operated so as to allow the nitrogen gas from the input 24 to pressurize an upper side of the diaphragm 15. When the upper side of the diaphragm 15 is pressurized, the bottom valve 12 is opened, thus increasing pressure at a lower side (i.e., downstream pressure) of the diaphragm 15. The pressure sensor 17 measures the pressure at the lower side of the diaphragm 15. The pressure at the lower side (i.e., downstream pressure) of the diaphragm 15 is adjusted by opening and closing the three way valve 19 such that the pressures at the upper and lower sides of the diaphragm 15 are balanced at a preset value given by the input signal. In this manner, the pressure of the nitrogen gas to be supplied to the supply tube T is adjusted.

Figure 6:
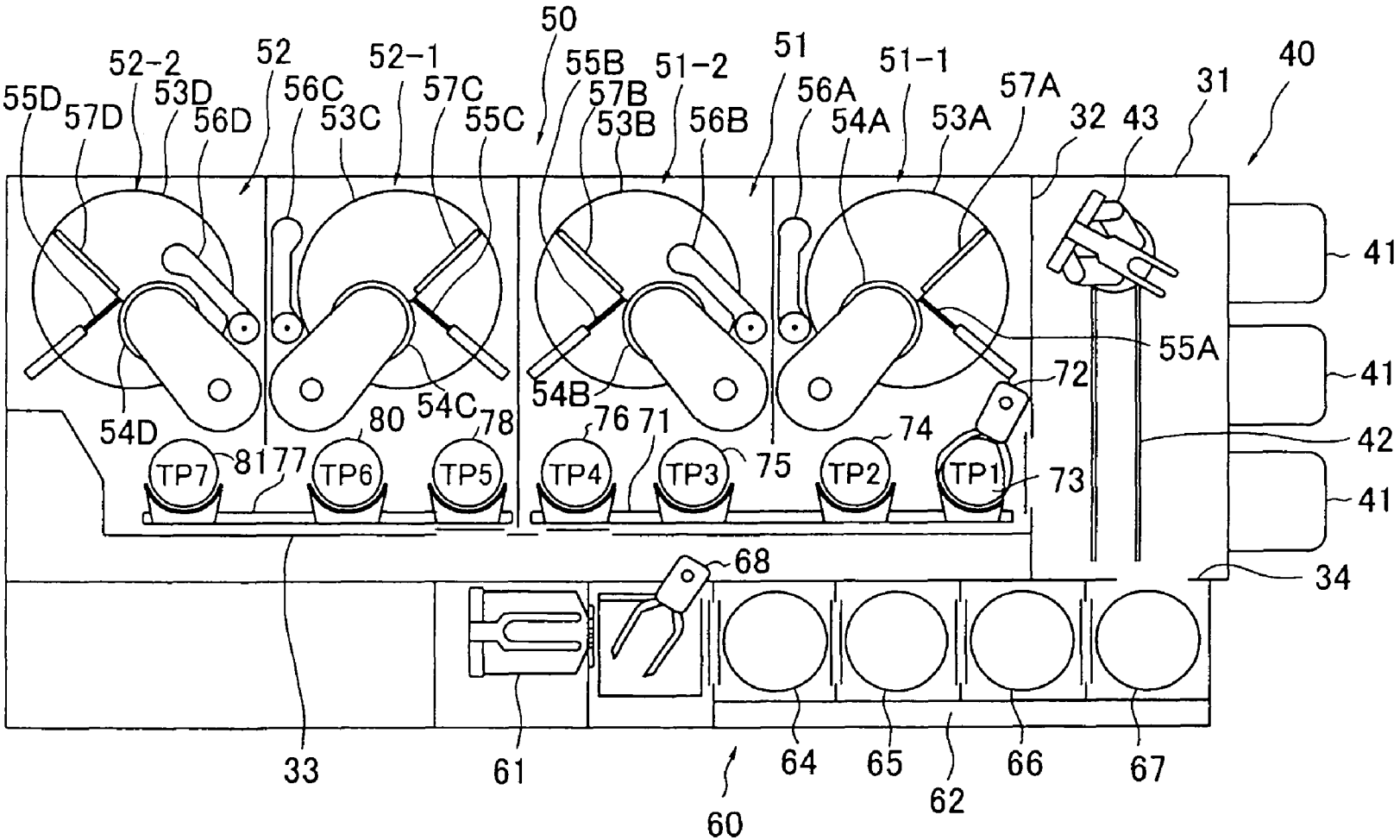
FIG. 6 is a plan view showing a structural example of a substrate polishing apparatus according to the present invention.

Next, a CMP apparatus incorporating the above-described liquid supply apparatus, serving as a polishing liquid supply unit, will be described. FIG. 6 is a plan view showing an entire arrangement of the CMP apparatus. This CMP apparatus has a housing 31 in a rectangular form. An interior space of the housing 31 is divided into a loading/unloading section 40, a polishing section 50, and a cleaning section 60 by partition walls 32, 33 and 34. The loading/unloading section 40, the polishing section 50, and the cleaning section 60 are assembled independently of each other, and evacuation of gases from these sections is performed independently of each other.

The loading/unloading section 40 has two or more front loading units 41 (three in the drawing) on which wafer cassettes, each storing a number of semiconductor wafers, are placed. The front loading units 41 are arranged adjacent to each other along a width direction of the CMP apparatus (a direction perpendicular to a longitudinal direction of the CMP apparatus). Each of the front loading units 41 can receive thereon an open cassette, a SMIF (Standard Manufacturing Interface) pod, or a FOUP (Front Opening Unified Pod). The SMIF and FOUP are a hermetically sealed container which houses a wafer cassette therein and covers it with a partition wall to thereby provide interior environments isolated from an external space.

The loading/unloading section 40 has a moving mechanism 42 extending along an arrangement direction of the front loading units 41. A first transfer robot 43 as a first transfer mechanism is installed on the moving mechanism 42 and is movable along the arrangement direction of the wafer cassettes. This first transfer robot 43 is operable to move along the moving mechanism 42 so as to access the wafer cassettes mounted on the front loading units 41. The first transfer robot 43 has vertically disposed two hands, which are separately used. For example, the upper hand can be used for returning a polished semiconductor wafer to the wafer cassette, and the lower hand can be used for transferring a non-polished semiconductor wafer.

The polishing section 50 is an area where a semiconductor wafer is polished. This polishing section 50 comprises a first polishing section 51 having a first polishing unit 51-1 and a second polishing unit 51-2 therein, and further comprises a second polishing section 52 having a third polishing unit 52-1 and a fourth polishing unit 52-2 therein. These first polishing unit 51-1, the second polishing unit 51-2, the third polishing unit 52-1, and the fourth polishing unit 52-2 are arranged along the longitudinal direction of the apparatus.

As shown in FIG. 6, the first polishing unit 51-1 comprises a polishing table 53A having a polishing surface, a top ring 54A serving as a substrate holding mechanism for holding a semiconductor wafer and pressing the semiconductor wafer against the polishing table 53A so as to polish the wafer, a polishing liquid supply nozzle 55A for supplying a polishing liquid or a dressing liquid (e.g., water) onto the polishing table 53A, a dresser 56A for dressing the polishing table 53A, and an atomizer 57A having one or more nozzles for ejecting a mixture of a liquid (e.g., pure water) and gas (e.g., nitrogen gas) in an atomized state toward the polishing surface of the polishing table 53A.

Similarly, the second polishing unit 51-2 comprises a polishing table 53B, a top ring 54B, a polishing liquid supply nozzle 55B, a dresser 56B, and an atomizer 57B. The third polishing unit 52-1 comprises a polishing table 53C, a top ring 54C, a polishing liquid supply nozzle 55C, a dresser 56C, and an atomizer 57C. The fourth polishing unit 52-2 comprises a polishing table 53D, a top ring 54D, a polishing liquid supply nozzle 55D, a dresser 56D, and an atomizer 57D. The above-described polishing liquid supply nozzles 55A, 55B, 55C and 55D are connected to the polishing liquid supply pipe L5 of the liquid supply apparatus shown in FIG. 2.

A first linear transporter 71, serving as a second (linear-motion) transfer mechanism, is disposed between the first polishing unit 51-1 and second polishing unit 51-2 of the first polishing section 51 and the cleaning section 60. This first linear transporter 71 is for transferring a wafer between four transferring positions located along the longitudinal direction of the CMP apparatus (hereinafter, these four transferring positions will be referred to as a first transferring position TP1, a second transferring position TP2, a third transferring position TP3, and a fourth transferring position TP4 in the order from the loading/unloading section 40). A reversing machine 72 for reversing a wafer received from the transfer robot 43 of the loading/unloading section 40 is disposed above the first transferring position TP1 of the first linear transporter 71, and a vertically movable lifter 73 is disposed below the first transferring position TP1. A vertically movable pusher 74 is disposed below the second transferring position TP2, and a vertically movable pusher 75 is disposed below the third transferring position TP3. A vertically movable lifter 76 is disposed below the fourth transferring position TP4.

In the second polishing section 52, a second linear transporter 77, serving as a second (linear-motion) transfer mechanism, is disposed adjacent to the first linear transporter 71. This second linear transporter 77 is for transferring a semiconductor wafer between three transferring positions located along the longitudinal direction of the CMP apparatus (hereinafter, these three transferring positions will be referred to as a fifth transferring position TP5, a sixth transferring position TP6, and a seventh transferring position TP7 in the order from the loading/unloading section 40). A vertically movable lifter 78 is disposed below the fifth transferring position TP5 of the second linear transporter 77. A vertically movable pusher 80 is disposed below the sixth transferring position TP6, and a vertically movable pusher 81 is disposed below the seventh transferring position TP7.

The cleaning section 60 is an area where a polished semiconductor wafer is cleaned. The cleaning section 60 comprises a second transfer robot 61, a reversing machine 68 for reversing a semiconductor wafer received from the second transfer robot 61, four cleaning devices 64-67 for cleaning a semiconductor wafer which has been polished, and a transfer unit 46 serving as a third transfer mechanism for transferring a wafer between the reversing machine 68 and the cleaning devices 64-67. The second transfer robot 61, the reversing machine 68, and the cleaning devices 64-67 are arranged in series along the longitudinal direction of the CMP apparatus. A filter fan unit (not shown in the drawings), having a clean air filter, is provided above the cleaning devices 64-67. This filter fan unit serves to remove particles from air to produce clean air, and to form downward flow of the clean air at all times. Further, pressure in the cleaning section 60 is kept higher than that in the polishing section 50 at all times, so that particles in the polishing section 50 are prevented from flowing into the cleaning section 60.

Next, polishing of a semiconductor wafer performed by the above-described CMP apparatus will be described. The followings are the case of serial processing of a semiconductor wafer. The upper hand of the first transfer robot 43 removes a semiconductor wafer from the wafer cassette of the front loading unit 41, and transfers the semiconductor wafer to the reversing machine 72, which then turns the semiconductor wafer upside down. The lifter 73, located at the first transferring position, transfers the reversed semiconductor wafer to the first linear transporter 71, which moves the semiconductor wafer to the second transferring position TP2. Then, the pusher 74 receives the semiconductor wafer, and transfers the semiconductor wafer to the top ring 54A at the second transferring position TP2. The top ring 54A presses the semiconductor wafer against the polishing surface of the polishing table 53A to thereby polish the semiconductor wafer.

The pusher 74 receives the polished semiconductor wafer from the top ring 54A at the second transferring position TP2. The pusher 74 transfers the semiconductor wafer to the first linear transporter 71, which then moves the semiconductor wafer to the third transferring position TP3. The pusher 75 receives the semiconductor wafer, and transfers the semiconductor wafer to the top ring 54B at the third transferring position TP3. The top ring 54B presses the semiconductor wafer against the polishing surface of the polishing table 53B to thereby polish the semiconductor wafer. The pusher 75, located at the third transferring position TP3, transfers the polished semiconductor wafer to the first linear transporter 71, which then moves the semiconductor wafer to the fourth transferring position TP4. The lifter 76, located at the fourth transferring position TP4, transfers the semiconductor wafer to the second transfer robot 61, which then transfers the semiconductor wafer to the lifter 78 located at the fifth transferring position TP5. The lifter 78 transfers the semiconductor wafer to the second linear transporter 77, which moves the semiconductor wafer to the sixth transferring position TP6. Then, the pusher 80 transfers the semiconductor wafer to the top ring 54C at the sixth transferring position TP6. The top ring 54C presses the semiconductor wafer against the polishing surface of the polishing table 53C to thereby polish the semiconductor wafer.

The pusher 80 receives the polished semiconductor wafer from the top ring 54C at the sixth transferring position TP6 and transfers the semiconductor wafer to the second linear transporter 77, which then moves the semiconductor wafer to the seventh transferring position TP7. The pusher 81 transfers the semiconductor wafer to the top ring 54D at the seventh transferring position TP7. The top ring 54D presses the semiconductor wafer against the polishing surface of the polishing table 53D to thereby polish the semiconductor wafer. The pusher 81 receives the polished semiconductor wafer from the top ring 54D at seventh transferring position TP7, and transfers the semiconductor wafer to the second linear transporter 77, which then moves the semiconductor wafer to the fifth transferring position TP5. The lifter 78 transfers the semiconductor wafer to the second transfer robot 61. The second transfer robot 61 transfers the semiconductor wafer to the reversing machine 68, which reverses the semiconductor wafer. Then, the chucking unit of the transfer unit 62 receives the reversed semiconductor wafer. The semiconductor wafer is transferred to the chucking unit, the first cleaning device 64, the chucking unit, the second cleaning device 65, the chucking unit, the third cleaning device 66, the chucking unit, and the fourth cleaning unit 67, whereby the semiconductor wafer is cleaned. Subsequently, the upper hand of the first transfer robot 43 transfers the semiconductor wafer into the wafer cassette of the front loading unit 41.

Although a certain preferred embodiment of the present invention has been described, the present invention is not intended to be limited to the embodiment described above. Moreover, it should be understood that various changes and modifications may be made without departing from the scope of the claims for patent, and the scope of the technical concept described in the specification and drawings. Any shape, structure, and material that are not directly described in the specification and the drawings are within the scope of the technical concept of the present invention so long as they provide the same effects of the present invention. For example, although the above described embodiment shows an example in which the liquid supply apparatus is used as the polishing liquid supply unit for supplying the polishing liquid onto the polishing surface of the polishing table of the CMP apparatus, the present invention is not limited to this example, but can be widely used as a liquid supply apparatus which does not cause clogging of a pipe with components contained in a liquid and does not cause a change in property of the liquid.

What is claimed is:

1. An apparatus for supplying a liquid from a liquid supply source to a predetermined liquid-supply area at a predetermined flow rate, said apparatus comprising:

at least one supply tube for retaining the liquid supplied from the liquid supply source, said at least one supply tube being vertically oriented;

a pressurized gas supply mechanism for supplying a pressurized gas from a gas source to said at least one supply tube;

a gas pressure adjusting mechanism for adjusting pressure of the pressurized gas to be supplied from the gas source to said at least one supply tube;

a level sensor configured to continuously detect a level of the liquid in a respective one of said at least one supply tube;

a control unit configured to:

determine a flow rate of the liquid discharged from said at least one supply tube based on a level of the liquid detected by said level sensor; and operate said gas pressure adjusting mechanism so as to maintain the predetermined flow rate based on a difference between the determined flow rate and the predetermined flow rate; and a pipe having no narrow portion, said pipe extending from the liquid supply source to said at least one supply tube, and from said at least one supply tube to the predetermined liquid-supply area;

wherein said gas pressure adjusting mechanism is configured to control a pressure of the gas supplied to said at least one supply tube by said pressurized gas supply mechanism so as to force the liquid out of said at least one supply tube and supply the liquid to the predetermined liquid-supply area via said pipe at the predetermined flow rate.

2. The apparatus according to claim 1, wherein:

said at least one supply tube comprises plural supply tubes; and said at least one supply tube, said pressurized gas supply mechanism, said gas pressure adjusting mechanism, and said pipe are configured so that supplying and discharging of the liquid are repeated between said plural supply tubes in coordination with each other so as to continuously supply the liquid to the liquid-supply area at the predetermined flow rate.

3. The apparatus according to claim 2, further comprising:

a cleaning mechanism for supplying a cleaning liquid into said plural supply tubes so as to clean said plural supply tubes, wherein said cleaning mechanism is operable to successively clean interiors of said plural supply tubes upon termination of discharging of the liquid while the liquid is continuously supplied to the liquid-supply area.

4. The apparatus according to claim 1, further comprising:

a flow rate detection device for detecting the flow rate of the liquid to be supplied to the liquid-supply area by continuously measuring a liquid level in said at least one supply tube, wherein said gas pressure adjusting mechanism is operable to control the flow rate of the liquid based on an output signal of said flow rate detection device.

5. A substrate polishing apparatus, comprising:

a polishing table having a polishing surface;

a polishing liquid supply unit for supplying a polishing liquid onto said polishing surface; and a substrate holding mechanism for holding a substrate and pressing the substrate against said polishing surface, said polishing table and said substrate holding mechanism being operable to provide relative movement between said polishing surface and the substrate to thereby polish the substrate, wherein said polishing liquid supply unit comprises a liquid supply apparatus according to claim 4, said polishing surface constituting the predetermined liquid-supply area.

6. The apparatus according to claim 1, wherein said control unit is configured to operate said gas pressure adjusting mechanism so as to maintain the predetermined flow rate through a feedback control based on the difference between the determined flow rate and the predetermined flow rate.

* * * * *